US006767266B2

(12) United States Patent
Bolen

(10) Patent No.: US 6,767,266 B2
(45) Date of Patent: Jul. 27, 2004

(54) STABILIZING ELEMENT FOR USE ON MOBILE DEVICES

(76) Inventor: Robert Bolen, 1818 Pine St., Huntington Beach, CA (US) 92648

( * ) Notice: Subject to any disclaimer, the term of this patent is extended or adjusted under 35 U.S.C. 154(b) by 0 days.

(21) Appl. No.: 10/109,273

(22) Filed: Mar. 27, 2002

(65) Prior Publication Data

US 2002/0102890 A1 Aug. 1, 2002

Related U.S. Application Data

(63) Continuation-in-part of application No. 09/783,695, filed on Feb. 14, 2001, now Pat. No. 6,379,204, which is a continuation of application No. 08/335,463, filed on Jun. 17, 1999, now Pat. No. 6,217,402, which is a continuation-in-part of application No. 09/098,400, filed on Jun. 17, 1998, now Pat. No. 6,106,346.

(51) Int. Cl.[7] ..... B63B 1/00
(52) U.S. Cl. ..... 441/79; 114/140; 114/39.15
(58) Field of Search ..... 441/65, 74, 79, 441/274; 440/66

(56) References Cited

U.S. PATENT DOCUMENTS

| | | | | |
|---|---|---|---|---|
| 3,089,157 A | | 5/1963 | May | |
| 3,103,673 A | | 9/1963 | Martin | |
| 3,137,265 A | | 6/1964 | Meyerhoff | |
| 3,605,672 A | * | 9/1971 | Strumbos | 114/166 |
| 4,288,223 A | * | 9/1981 | Gonzalez et al. | 440/71 |
| 4,968,275 A | * | 11/1990 | Carlson | 440/66 |
| 5,352,140 A | * | 10/1994 | Schriner | 440/67 |
| 5,435,763 A | * | 7/1995 | Pignata | 440/67 |

FOREIGN PATENT DOCUMENTS

| | | |
|---|---|---|
| AU | 576 896 | 9/1988 |
| DE | 3 509 229 A1 | 9/1986 |
| FR | 2 502 108 | 9/1982 |
| FR | 2 576 867 | 8/1988 |
| FR | 2 581 361 | 11/1988 |
| NL | 2 177 353 | 1/1987 |
| NL | 8 800 184 | 8/1989 |
| SU | 1 382 736 A1 | 3/1988 |

* cited by examiner

*Primary Examiner*—Stephen Avila
(74) *Attorney, Agent, or Firm*—Knobbe, Martens, Olson & Bear, LLP

(57) ABSTRACT

A stabilizer for a mobile device includes a first element that has a center-plane and an upper end for attachment to a bottom surface of the mobile device. The stabilizer also has a hollow tubular element that has a center-plane. The hollow tubular element is connected to the first element such that the center-plane of the hollow tubular element and the center-plane of the first element are not aligned.

48 Claims, 8 Drawing Sheets

FIG. 8
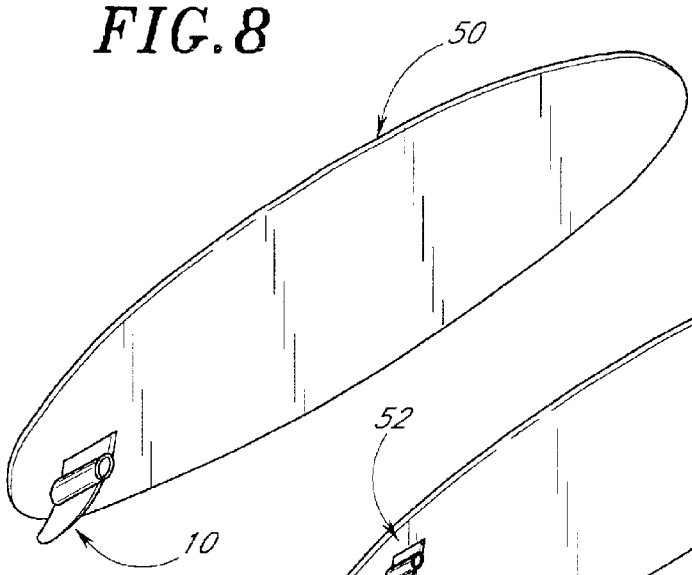
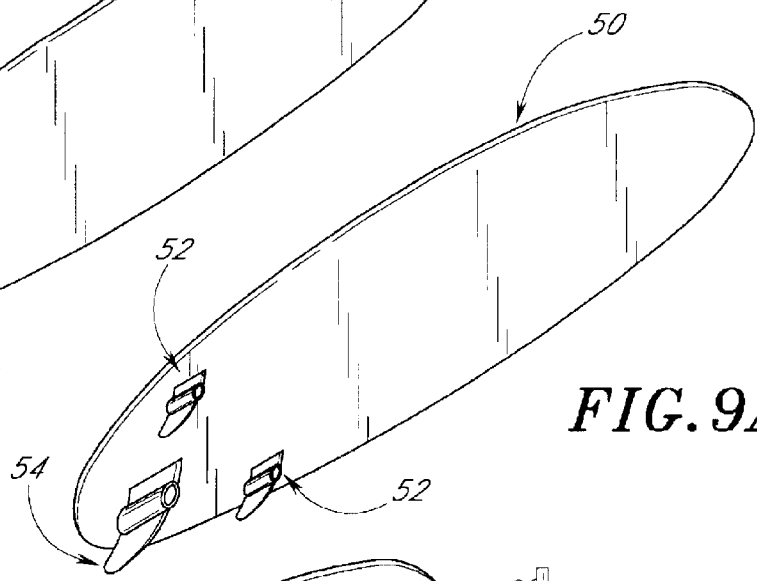
FIG. 9A
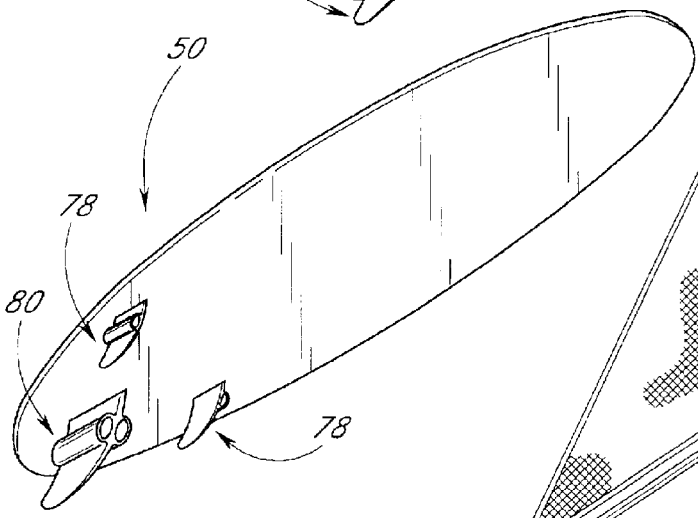
FIG. 9B
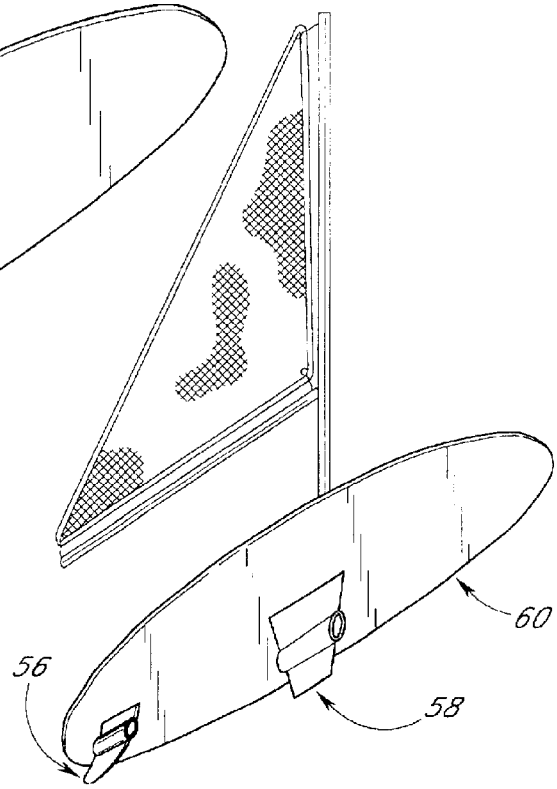
FIG. 10

STABILIZING ELEMENT FOR USE ON MOBILE DEVICES

RELATED APPLICATIONS

This application is a continuation-in-part of application Ser. No. 09/783,695, entitled STABILIZING ELEMENT FOR USE ON MOBILE DEVICES, filed Feb. 14, 2001, now U.S. Pat. No. 6,379,204, which is a continuation of application Ser. No. 09/335,463, entitled STABILIZING ELEMENT FOR USE ON MOBILE DEVICES, filed Jun. 17, 1999, now U.S. Pat. No. 6,217,402, which is a continuation-in-part of application Ser. No. 09/098,400, filed Jun. 17, 1998, entitled STABILIZING FIN FOR A WATER PLANING DEVICE, now U.S. Pat. No. 6,106,346, the entire contents of all of which are hereby incorporated by reference and made a part of this specification.

BACKGROUND OF THE INVENTION

1. Field of the Invention

The present invention in one embodiment relates to an improved foil, such as a fin or wing, having a stabilizing element that increases stability by reducing the effect of turbulence in air or water on mobile devices and which increases maneuverability of such devices.

2. Description of the Related Art

Many mobile devices have a foil, frequently a wing or a fin to stabilize their motion and provide lift. Nearly all types of watercraft use a vertical foil or fin to provide horizontal stability. Sailboats and other large watercraft frequently have a fin that is a direct extension of the hull. Surfboards and wind surfing boards often utilize one or more "shark-like" fins which may extend vertically up to 16 inches in a downward direction below the bottom surface of the surfboard or wind surfing board. This type of fin generally only stabilizes a boat, surfboard, or windsurfing board in a horizontal plane while riding through the water or on a wave under either smooth or rough water conditions. It offers little or no resistance to the vertical rise experienced during various watercraft maneuvers. Any maneuver that moves the weight forward and causes the rear of the watercraft or board to rise vertically may result in loss of control due to the fin losing contact with the wave or the water and result in a wipe out. Additionally as a wave becomes steeper and prepares to break, this type of fin, having only vertical design, will tend to lose contact with the face of the wave causing the loss of horizontal control and, in the case of a surfboard, allowing the board to slide sideways and cause a wipe out. Waves and turbulent water can also jar speedboats and sailboats or cause them to lose control.

The wings of airplanes or other aircraft have horizontal wings or stabilizers that provide lift and/or vertical stability, but the aircraft is still vulnerable to instability caused by turbulent air. Automobiles may also use a foil or blade appendage, commonly attached at the rear. This rear foil, sometimes known as a spoiler, provides downward force to help the tires maintain contact with the road. Like an airplane wing, however, the spoiler mostly provides stability in only one direction and is subject to the destabilizing effect of turbulent air. In short, most mobile devices have some type of airfoil, wing, or blade-like device that is designed to achieve stability, lift, and/or maneuverability, but there remain several disadvantages associated with these designs.

SUMMARY OF THE INVENTION

In one embodiment, the present invention advantageously reduces the effect of turbulent air or water upon a moving object, increases stability in a variety of directions and increases lift beyond foils currently in use. In another embodiment, the present invention also advantageously increases maneuverability of moving object in air, water or on land.

In one embodiment, a stabilizing element attaches to a water planing device or watercraft. It will be appreciated, however, that the stabilizing element can also be attached to other mobile devices, such as an automobile or an airplane, as described below. The stabilizing element which is preferably a stabilizing fin includes an upper vertical stabilizer element, a hollow tubular element, and a lower vertical stabilizer element. The upper vertical stabilizer element has an upper end for attachment to a bottom surface of a water planing device or watercraft. The hollow tubular element has an upper portion depending from a lower end of the upper vertical stabilizer element. The tubular element has an open front end and an open rear end. The lower vertical stabilizer element has an upper end depending from a lower portion of the hollow tubular element. During use thereof the upper and lower vertical stabilizer elements provide lateral stability and the hollow tubular element provides increased lateral stability and vertical stability for enhanced control by a user. The water planing device may be, for example, a surfboard or a wind surfing board. The watercraft may also be a sailboat or speedboat.

The stabilizing element stabilizes the water planing device or boat in a variety of directions under a variety of conditions. For example, this element gives the surfboard or wind surfing board rider longer, more controlled rides while the rider performs on the nose area of the board by holding the tail section down in the water. This element also gives the rider of the surfboard or a wind surfing board more control while riding through, in, or over the white water sections of waves while performing a variety of maneuvers. It gives the rider more control while riding on water or up or down a face of a steep wave on either a surfboard or a wind surfing board during either rough or smooth conditions. The stabilizing element stabilizes other watercraft in waves or turbulent water.

In accordance with one embodiment of the present invention, an increase in maneuverability is attained by the leading edge of the hollow element tapering to a defined edge. It is believed that this defined edge improves the maneuverability of the mobile device to which it is attached by biting into the fluid in which the mobile devices moves at the start of a turn.

In another embodiment, the hollow element, as it extends through the entire foil, maintains the foil shape of the entire fin or wing. This foil shape of the hollow element provides greater lift on the mobile device to which it is attached by creating more surface area against which the water or air may flow.

In another embodiment, the stabilizing element is attached to an aircraft. The wing of the aircraft has a hollow stabilizing element that helps provide additional lift and stability beyond wings currently in use.

In another embodiment, the stabilizing element attaches to the rear of an automobile, as a spoiler. Automobile spoilers are generally arranged to provide downward force to the rear tires, helping the tires remain in contact with the ground. The hollow element increases the surface area beyond commonly used spoilers, thereby allowing the spoiler to create more downward force without requiring greater length. In addition, the hollow element provides horizontal stability by channeling air through the body of the hollow element. It is also believed that the tapered front edges of the hollow tubular element increase maneuverability of the mobile device to which it is attached.

In another embodiment, the present invention comprises a stabilizer for a mobile device. The stabilizer has a first element that has a center-plane and an upper end for attachment to a bottom surface of the mobile device. The stabilizer also has a hollow tubular element that has a center-plane. The hollow tubular element is connected to the first element such that the center-plane of the hollow tubular element and the center-plane of the first element are not aligned.

In another embodiment, the present invention comprises a stabilizing system that includes a mobile device and a stabilizer. The stabilizer has a first element is connected to the mobile device and has a center-plane. The stabilizer also has a hollow tubular element that has a center-plane. The hollow tubular element is connected to the first element such that the center-plane of the hollow tubular element and the center-plane of the first element are offset. The hollow tubular element provides increased stability in at least two directions for enhanced control by a user of the mobile device and/or the stabilizing system.

In another embodiment, the present invention comprises a stabilizing fin for a water planing device that has an upper vertical stabilizer element, an arcuate element, and a lower vertical stabilizer element. The upper vertical stabilizer element has an upper end for attachment to a bottom surface of the water planing device. The arcuate element has an upper portion depending from a lower end of the upper vertical stabilizer element. The lower vertical stabilizer element has an upper end depending from a lower portion of the arcuate element.

In another embodiment, the present invention comprises a stabilizing system that includes a mobile device, and a stabilizer. The stabilizer comprises an upper vertical stabilizer element, an arcuate element, and a lower vertical stabilizer element. The upper vertical stabilizer element has an upper end for attachment to a bottom surface of the mobile device. The arcuate element has an upper portion depending from a lower end of the upper vertical stabilizer element. The lower vertical stabilizer element has an upper end depending from a lower portion of the arcuate element.

BRIEF DESCRIPTION OF THE DRAWINGS

FIG. 8 is a perspective view of a surfboard with one embodiment of the stabilizing fin of the present invention attached thereto.

FIG. 9A is a surfboard with an arrangement of a plurality of stabilizing fins of another type attached thereto.

FIG. 9B illustrates another arrangement of stabilizing fins on the surfboard.

FIG. 10 is a wind surfing board with an arrangement of a plurality of stabilizing fins of another type mounted thereto.

The same reference characters designate the same parts or elements throughout the drawings.

DETAILED DESCRIPTION OF THE PREFERRED EMBODIMENTS

Figure 18:
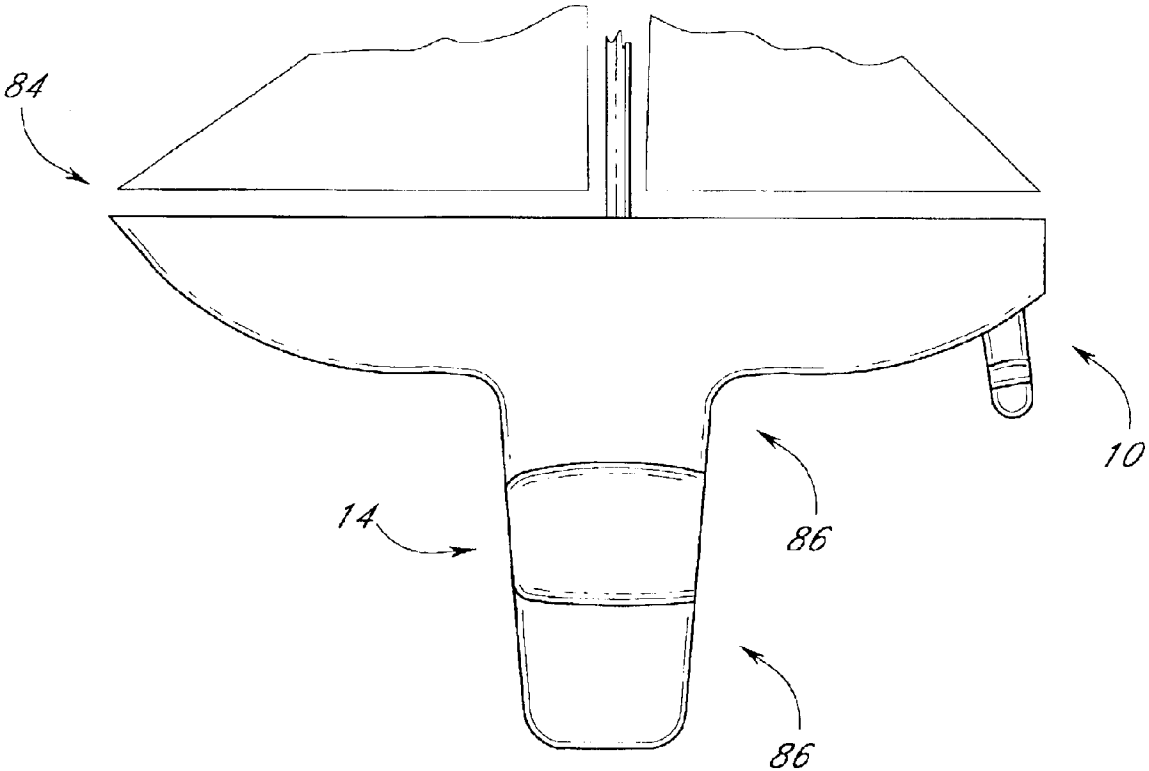
FIG. 18 is a side view of the sailboat of FIG. 17, with a large hollow element contiguous with the hull and a smaller stabilizing fin attached at the rear of the boat.
Figure 19:
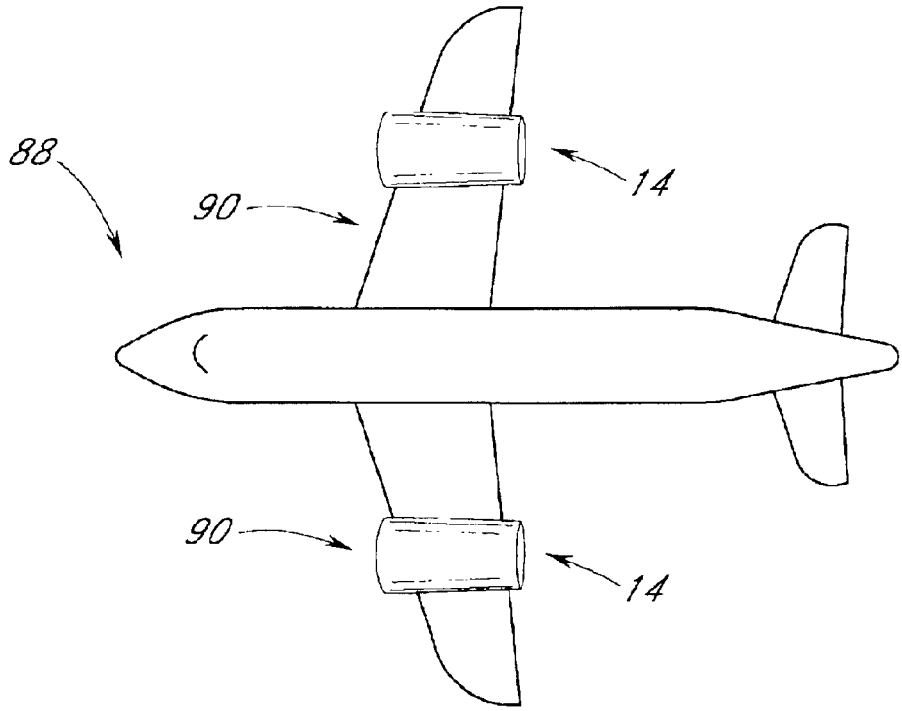
FIG. 19 is a top view of an airplane, where foils with hollow elements make up the wings of the airplane.

Referring now to the drawings and the characters of reference marked thereon, FIGS. 1–7 illustrate a first embodiment of the present invention, designated generally as 10. Stabilizing fin 10 includes an upper vertical stabilizer element 12, a hollow tubular element 14 and a lower vertical stabilizer element 16. The upper vertical stabilizer element 12 is generally shaped as a single vertically oriented plate or blade having a generally planar configuration. It has an upper end 18 which preferably attaches to a bottom surface of a water planing device (not shown). It may be attached by means well known in the art (either permanently affixed or removable). Preferably, for surfboard applications, the length of the upper end 18 of the upper vertical stabilizer element 12 of the fin 10 from the front of the fin 10 to the back of the fin 10 is between about five and three-eighths inches and about six and three-eighths inches. The upper vertical stabilizer element 12 may also be contiguous with the bottom surface or hull of a sailboat, as shown in FIGS. 18–19.

The hollow tubular element 14 has an upper portion 20 which depends from a lower end 22 of the upper vertical stabilizer element 12. Preferably, for surfboard applications, the length of the lower end 22 of the upper vertical stabilizer element 12 from the front of the fin 10 to the back of the fin 10 is between about four inches and about four and three-quarters inches. The tubular element 14 has an open front end 24 and an open rear end 26. The hollow element has, in one embodiment, a three dimensional shape having an upper outer surface 70, a lower outer surface 72, an upper interior surface 74, and a lower interior surface 76.

Figure 4:
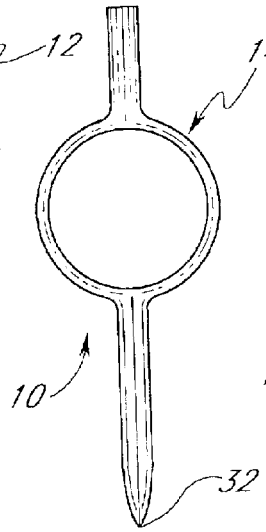
FIG. 4 is a rear end view of the stabilizing fin of FIG. 1.
Figure 5:
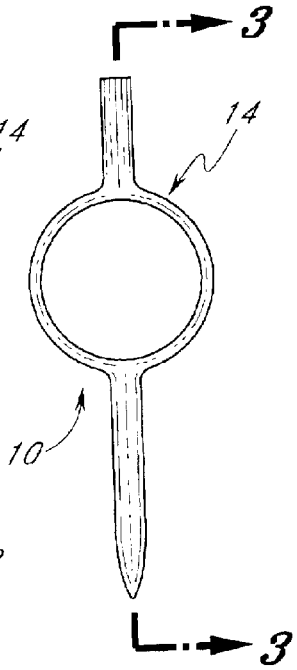
FIG. 5 is a front end view of the stabilizing fin of FIG. 1.

As can be seen in FIGS. 4 and 5, the hollow tubular element 14 is symmetrical about its vertical centerline. In this preferred embodiment, the hollow tubular element 14 has a substantially circular cross-section. Although the hollow element is tubular in this embodiment, the opening or passageway need not be tubular in shape.

The lower vertical stabilizer element 16 has an upper end 28 depending from a lower portion 30 of the hollow tubular element 14. Preferably, for surfboard applications, the length of the upper end 28 of the lower vertical stabilizer element 16 from the front of the fin 10 to the back of the fin 10 is between about three and one-half inches and about four inches. The upper vertical stabilizer element 12, the hollow tubular element 14 and the lower vertical stabilizer element 16 are preferably integrally connected. They may be formed of typical surfboard fin materials including, but not limited to, fiberglass, injection-molded plastic, and carbon fiber composites. The combination of shapes required by the stabilizing fin 10 particularly lend themselves to recent advances in carbon composite manufacturing processes.

Figure 6:
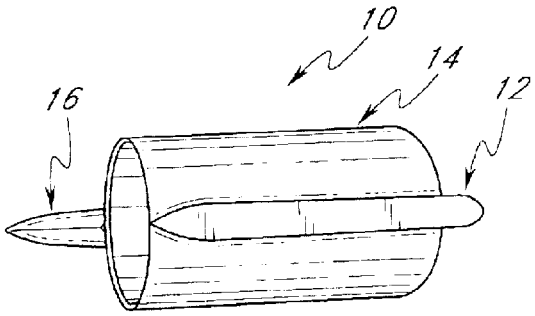
FIG. 6 is a top, rear perspective view of the stabilizing fin of FIG. 1.
Figure 7:
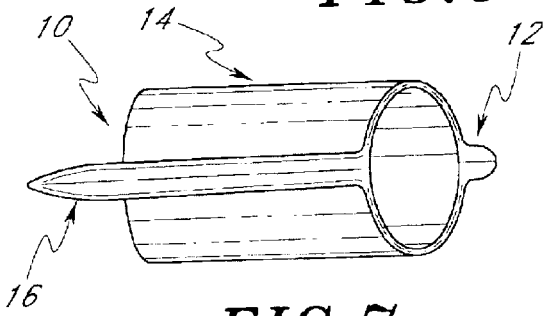
FIG. 7 is a bottom, front perspective view of the stabilizing fin of FIG. 1.

The front end of the hollow tubular element 14 preferably has a rounded leading edge and the rear end thereof preferably has a tapered trailing edge. Similarly, as can be seen in FIGS. 6 and 7, the upper vertical stabilizer element 12 and the lower vertical stabilizer element 16 have rounded leading edges and tapered trailing edges. The edges of the lower vertical stabilizer element 16 converge at a lower end 32.

Figure 1:
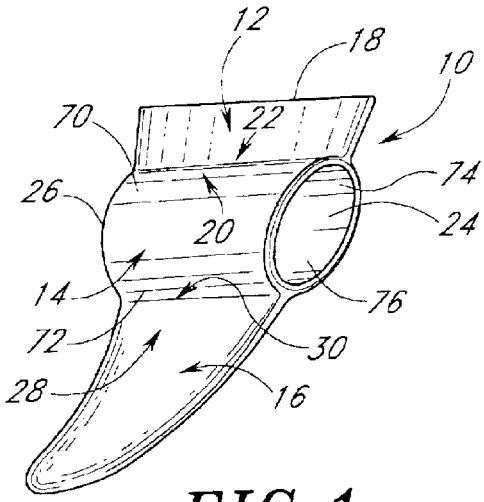
FIG. 1 is a front, side perspective view of one embodiment of a stabilizing fin.
Figure 2:
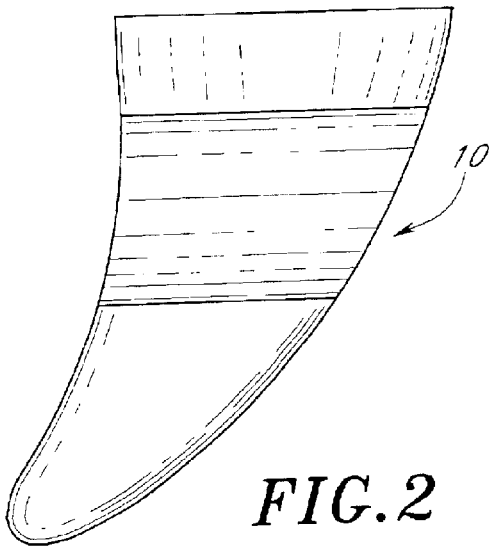
FIG. 2 is a side plan view of the stabilizing fin of FIG. 1.
Figure 3:
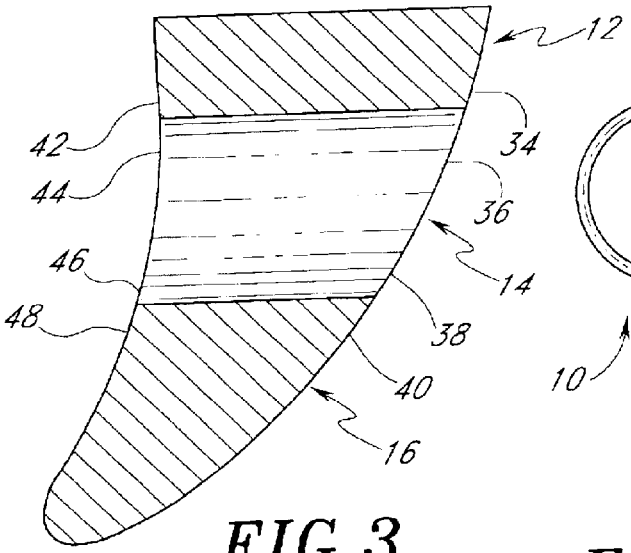
FIG. 3 is a cross-sectional view of the stabilizing fin of FIGS. 1 and 2, taken along the plane 3—3 shown in FIG. 5.

As can be seen, for example in FIG. 3, a lower front portion 34 of the upper vertical stabilizer element 12 is contiguous with an upper front portion 36 of the hollow tubular element 14. A lower front portion 38 from the hollow tubular element 14 is contiguous with an upper front portion 40 of the lower vertical stabilizer element 16. Furthermore, a lower rear portion 42 of the upper vertical stabilizer element 12 is contiguous with an upper rear portion 44 of the hollow tubular element 14. A lower rear portion 46 of the hollow tubular element 14 is contiguous with an upper rear portion 48 of the lower vertical stabilizer element 16. Thus, as can be seen in for example in FIG. 3, a continuous curve side profile of the fin 10 is provided.

For a surfboard, the distance from the top of the upper vertical stabilizer element 12 to the bottom of the lower vertical stabilizer element 16 may be from about 3 inches to about 15 inches. In one embodiment, this distance is about 6.5 inches. In another embodiment this distance is about 7.5 inches. In yet another embodiment, this distance is about 8.5 inches. In another embodiment, this distance is about 9.5 inches. For a wind surfing board this distance may be about 20 inches.

The upper vertical stabilizer element 12 may have a width, i.e., the distance from front to back, on the order of about four inches to about six inches.

The lower vertical stabilizer element 16 may have a width that tapers from about 3 inches at the upper end down to the tip or perhaps as much as about 6 inches down to the tip.

In general, the hollow tubular element 14 has a diameter that varies with the size of the stabilizing element with which it is associated. The hollow tubular element 14 will be generally larger if it is associated with a larger stabilizing element. The hollow tubular element 14 will be generally smaller if it is associated with a smaller stabilizing element. In one embodiment, the hollow tubular element 14 has a diameter of about 1 inch to about 3 inches for applications with a surfboard. This diameter may be substantially increased for applications on a wind surfing board. As discussed further below, the hollow tubular element has a non-constant diameter from front to back in one embodiment. For surfboard applications, the open front end 24 has, in one embodiments, a diameter between about one and eleven-sixteenths and about one and three-quarters inches. For surfboard applications, the open rear end 26 has, in one embodiments, a diameter between about one and seven-sixteenths and about one and one-half inches.

The location of the hollow tubular element 14 with respect to the upper vertical stabilizer element 12 and the lower vertical stabilizer element 16 can vary depending on the application, e.g., depending on the type of mobile device employed or the performance desired. For some applications, the hollow tubular element 14 is placed closer to the lower end of lower vertical stabilizer element 16 than is shown in the figures. This can provide additional stabilization and lift for the surfboard, wind-surfing board, or other mobile device. For some applications, the hollow tubular element 14 is placed closer to the top of the upper stabilizer element 12 than is shown in the figures.

Referring now to FIG. 8, application of the stabilizing fin 10 is illustrated on a surfboard 50.

FIG. 9A shows an alternate arrangement of the stabilizing fin on a surfboard 50. In this instance, two relatively small stabilizing fins 52 are positioned side-by-side forward of a relatively large fin 54 that is located near the back of the surfboard 50. This fin configuration provides an enhanced stabilizing effect on relative large, steep waves. As noted above, the stabilizing fins may be permanently affixed to the board or removable and adjustable to, for example, the configuration shown in FIG. 9A.

FIG. 9B shows a surfboard 50 with an arrangement of another type of stabilizing fin. The two forward fins 78 have a hollow element attached on one side. As illustrated in FIG. 9B, the rear fin 80 has two hollow elements, one on each side of the fin 80. However, in another embodiment (not shown), the rear fin is a regular straight fin, without a hollow element, and the two forward fins 78 have hollow elements attached on the outward facing side. In still another embodiment, the rear fin 80 is removed and the surfboard 50 has the two fins 78, which may be positioned as shown in FIG. 9B, or in any other position that provides enhanced stabilization of the surfboard 50. The arrangement shown and described in relation to FIGS. 9 and 9A may also be used on a wind-surfing board or other water planing device, or on a mobile device generally. Another embodiment of the fin 78 is described in more detail below in connection with FIGS. 21–22.

FIG. 10 shows implementation of stabilizing fins, 56, 58 on a wind surfing board 60. Stabilizing fin 58 is attached near the center of the wind surfing board 60. Stabilizing fin 56 is attached near the rear of the board 60. This arrangement is shown by way of example. There are many different configurations of stabilizing fins that can be adapted in accordance with the principles of the present invention.

Figure 11:
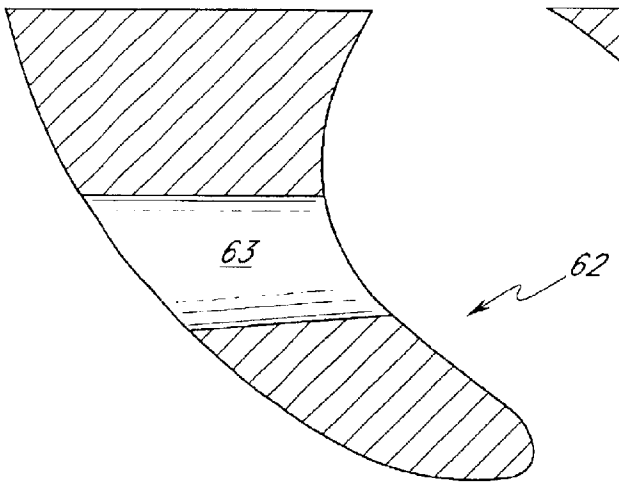
FIG. 11 is a cross-sectional view of an alternative stabilizing fin, which is more greatly swept back than the FIG. 1 embodiment.

FIG. 11 shows a stabilizing fin 62 with a fin profile which is swept back to a greater degree than in the embodiment of FIG. 1–7. This is useful for creating a more drawn-out turn on the water planing or mobile device, e.g., on a surfboard. Additionally, the fin 62 is more suitable for surfing in areas with an abundance of kelp, seaweed and rocks. As is shown in FIG. 11, the hollow tubular element 64 can extend completely from the leading edge of the fin 62 to the trailing edge thereof. The element 63 can extend only partway from the leading edge to the trailing edge, with side vents or exhausts allowing the exit of fluid from the fin 64. In another embodiment (not shown), the hollow tubular element 63 can extend partway from the trailing edge toward the leading edge.

Figure 12:
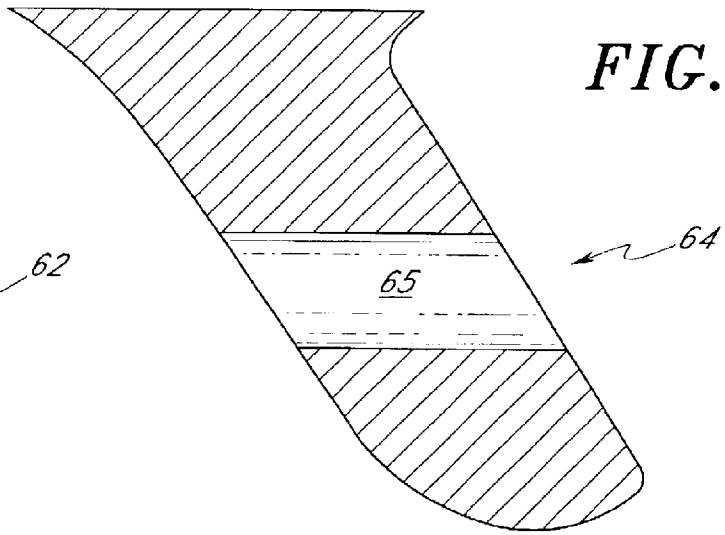
FIG. 12 is a cross-sectional view of another fin profile which is more vertically oriented than the embodiment of FIG. 1.

FIG. 12 illustrates a stabilizing fin 64 with a fin profile that has linear front and rear edges to allow the user of the mobile device to which it is attached to make more of a pivot turn. Although only two fin shapes are shown, the stabilizing fins and stabilizers described herein may be formed in many shapes, sizes and thicknesses. In addition, although the stabilizing fin 64 is shown in FIG. 12 as being symmetrical, it may also take on an asymmetrical configuration, such as one having an airfoil shape in cross section. Such a configuration can have the effect of producing a lift on the fin, both due to the flow of fluid over the outer extremities of the hollow element 65 as well as the flow of fluid through its interior.

Figures 13, 14:
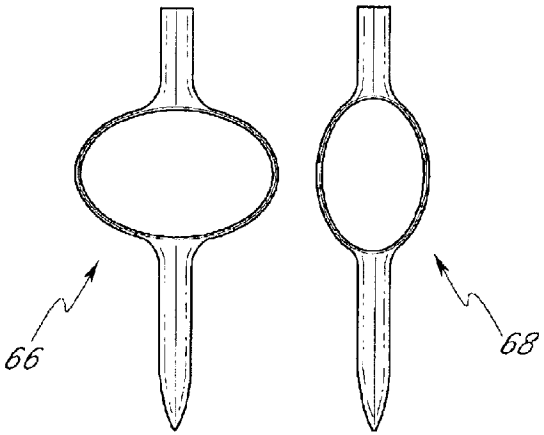
FIG. 13 is a rear end view of another embodiment of the stabilizing fin which has a hollow tubular element with an elliptical shape.
FIG. 14 is a rear end view of another embodiment of the stabilizing fin having an elliptical tubular element that is oriented 90 degrees from the embodiment of FIG. 13.

FIG. 13 shows a fin 66 having a hollow tubular element with a non-circular cross-section. FIG. 14 shows a fin 68 having a hollow tubular element with a non-circular cross-section. Thus, the hollow tubular element may be incorporated into a fin, blade, airfoil, and the like, in such a manner as to extend outwardly away from the fin, as shown in FIGS. 13 and 14, or may be incorporated therein to more closely align itself with the sides of the fin, as would be more the case in a sailboat fin shown in FIG. 84. That is, the effects of the element, as explained herein, stem both from its interior surfaces as well as its extending surfaces, if any.

Although the hollow tubular element 14 has been shown with a generally circular cross-section, it may have other shapes although these other shapes should be symmetrical about the center line to provide the best stability. For example, referring now to FIG. 13, a fin 66 is shown with an elliptical hollow tubular element. FIG. 14 shows another "elliptical" embodiment, designated generally as 68, with the ellipse oriented in another position.

The hollow tubular element in all these instances may serve as a device for connecting the surfboard to a rack or other permanent fixture for locking purposes. In addition, the element may be mounted on a mobile device by single or plural blades or fins, or may be cantilevered therefrom.

Figure 15:
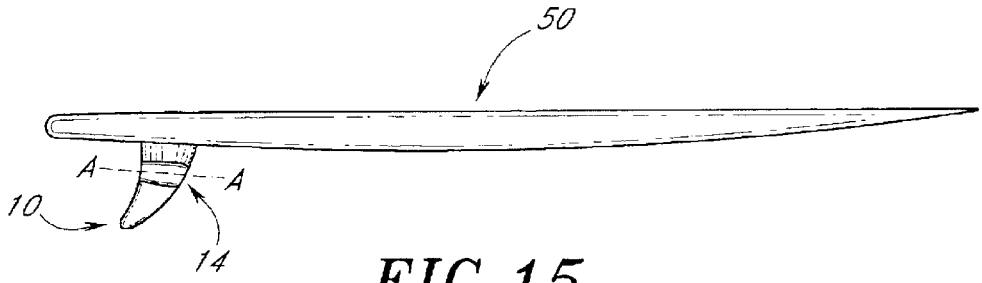
FIG. 15 is a side view of the stabilizing fin of FIG. 1 mounted on a surfboard.

FIG. 15 shows a side view of a surfboard 50 with a stabilizing fin 10 mounted on the underside of the board. The stabilizing fin 10 in this embodiment provides a force that holds the tail of the surfboard 50 down, helping stabilize the board 50 in waves and turbulent water and allowing the rider to move toward the front of the board 50. As illustrated in FIG. 15, the underside of a surfboard or windsurfing board usually has rocker, meaning the board curves up from the midpoint of the board, curving up at both the nose and the tail. This rocker or curve keeps the hollow element 14 at a slight downward angle A—A, causing water to deflect off the top exterior surface 70 and the bottom interior surface 76 of the hollow element. This water deflection maintains a slight downward force even when the board is at a natural position.

When the nose of the surfboard dips down and the tail tips up, from wave action or the rider's weight, the hollow element and fin 10 begin to tilt further down. The more the hollow element angles down, the more the top exterior surface 70 of the hollow element resists against the flow of water as more of the full top exterior surface 70 opposes the forward velocity. This downward force pulls the tail of the surfboard 50 back down into the water. As the downward angle from tail to nose gets steeper and the angle of the hollow element increases, more downward force will be exerted upon the tail by the stabilizing fin. As a result, the stabilizing fin allows a surfer to ride the nose of the surfboard 50 longer. In addition, the destabilizing effect of turbulence and wave action is minimized. Once the board 50 is no longer at an angle and the nose no longer points down, the hollow element will not drive the board's tail down. This same principle can be used in other watercraft to decrease the effect of turbulence, helping the craft glide more smoothly and efficiently by holding the underside of the craft to the surface of the water.

Figure 16A:
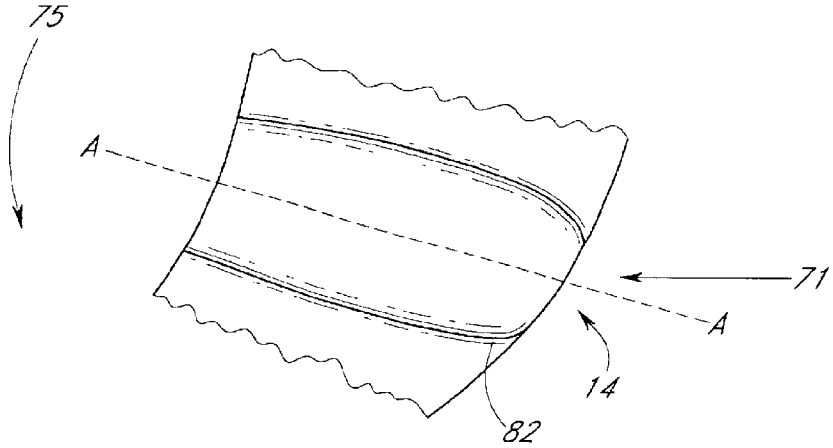
FIGS. 16A and 16B are side views of the hollow portion of a foil.

The stabilizing hollow element 14 shown in FIG. 16A has a bottom leading edge 82 that curves upward, towards the center of the hollow element. The upward-curved leading edge counteracts the downward pull of the stabilizing element. When the tail of the water planing device dives into the water, such as when the surfer turns or otherwise puts his or her weight on the tail of the surfboard 50, thus putting the tail into the water at an angle, the curved profile of the leading edge 82 provides counteracting lift. The greater the angle that the tail dips into the water, the greater upward force this feature creates, preventing the hollow element from driving the tail of the water planing device too deep below the water's surface.

In general, the hollow tubular element 14 provides an increased wetted surface area of the fin. The continuous water flow around and through the increased wetted surface area of the stabilizing fin allows for more control of surfboards and wind surfing boards in all directions while the operator is directing the surfboard or wind surfing board through the water or up and down the face of waves. The curve of the hollow element 14 allows it to hold on to a curving or breaking wave, where a similar wing-like stabilizing element only cuts across the wave.

The three dimensional shape of the stabilizing fin increases surface area against which water flow can exert its force. The circular or rounded shape of one embodiment allows the surface area to create force when the board 50 and fin 10 tilt in any number of directions. Thus, the hollow element 14 provides stability in a variety of directions. In addition, these principles also apply to the other applications of the stabilizing element, such as for example, on aircraft, automobiles, and other mobile devices.

The hollow shape of one embodiment of the invention nearly always allows two surfaces to be exposed to the water flow (upward or downward depending on the tilt of the board). Generally, fluid can exert force against both an exterior surface and an opposite interior surface of the hollow tubular element 14, providing stability and lift in a variety of directions. As a result, water can exert more force against a fin with the hollow stabilizing element than water could against a fin that extended only horizontally through the main fin, having a single surface. The hollow element can also channel fluid through its length, thus minimizing the effect of turbulent flow on the moving object as a whole.

The stabilizing fin also aids turning. For example, when a surfer begins a turn, the surfer steps back to the tail of the board, pushing the tail down and bringing the nose up. When the rider's weight is on the rear of the board and the rider begins to lean the board to one side to make the turn, the upper interior surface 74 of the hollow element becomes more exposed to the force of the water's velocity. As that surface becomes more exposed, the water flow exerts an upward force on the tail, helping lift the tail of the board out of the water and making the turn smoother and easier.

Furthermore, as the rider leans the board to one side to begin a turn, the lean of the board exposes the side interior surface of the hollow element, pushing against the side corresponding to the direction of the turn. As a result of water flow against the upper interior surface 74 and a side portion of the upper inside surface 74, turning is easier and smoother.

In another embodiment, the hollow element tapers to a defined edge at the leading edge and at the trailing edge. This tapered shape is similar to the foil shape of a fin or wing. In some embodiments, the interior of the hollow element is straight, not foiled. It is believed that the straight interior creates a vortex within the aperture, giving increased stability and creating increased maneuverability.

In one embodiment, illustrated in FIG. 16A, the position of the hollow tubular element 14 below the surface of the water allows the stabilizing element to reach below the choppy or turbulent water to smooth water below. In this illustration, the tail of the surfboard 50 is rising out of the water, as can happen when the rider is on the nose of the board. In this case, the force of the water fluid, as illustrated by arrow 71, is incident at the leading edge of the hollow element 14 such that it deflects off of the lower, interior surface 73 of the element 14. This deflection causes the element, and therefore the fin 10 and board 50 itself, to be forced downward, as illustrated by the arrow 75, thereby tending to right itself or correct the rocking motion. This effect allows the surfer to ride on the nose longer or otherwise maintain a more stable ride. In addition, there is a propulsive effect (for example, the forces that may arise from the venturi effect of the element) from the water streaming out of the back of the hollow element, tending to give the surfer the feel that greater speed is achieved.

Figure 16B:
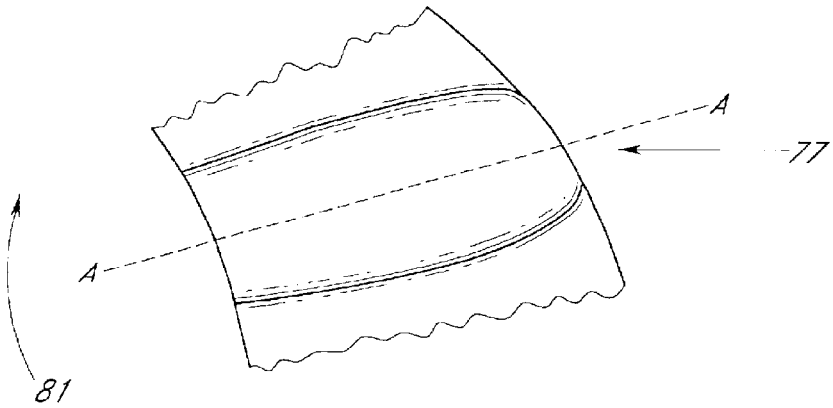

Likewise, as shown in FIG. 16B, if the surfer is riding at the tail of the surfboard or otherwise causes the tail to dive further into the water, the element 14 counteracts this motion. Thus, the water flow 77 impinges on upper interior surface 79 of the element 14 causing a corrective force on the surfboard as shown by arrow 81. Lift could also be achieved on the exterior surfaces of the element if extending away from the fin, as shown in FIGS. 13 and 14.

In one embodiment, the stabilizing fin 10 is a surfboard fin, as shown in FIG. 15, that extends about eight and one-half inches below the underside of the surfboard. The fin has a mounting element (not shown) that is about three-quarters of an inch tall and about six and one-quarter inches from leading to trailing edge. In one embodiment, the upper vertical stabilizer element 12 extends about one and one-quarter inches below the board's lower surface and is about four and one-half inches long (from leading edge to trailing edge) at its midsection. The open forward end of the hollow element 14 has a diameter between about one and eleven-sixteenths inches and about one and three quarters inches. The open rear end of the hollow element 14 has a diameter between about one and seven-sixteenths and about one and one-half inches. The hollow element 14 is about three and one-half inches from its leading to trailing edge. The lower vertical stabilizer element 16 sweeps back behind the hollow element 14, with its trailing end about four and one-half inches behind the trailing end of the hollow element 14. The length of the lower stabilizer element 16 is about seven inches from the lower portion 30 of the hollow element 14 to the tip of the fin 10.

Figure 17:
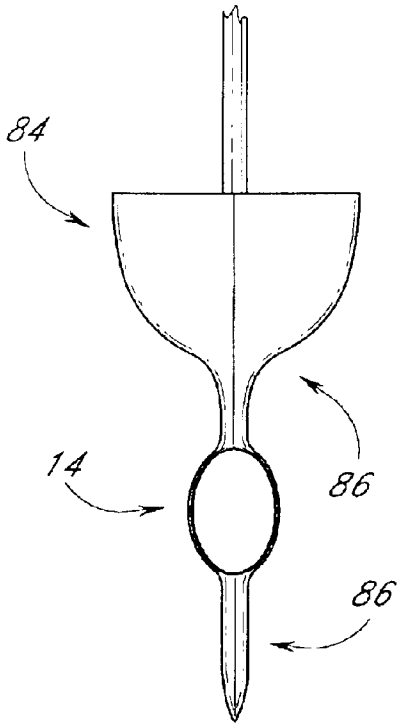
FIG. 17 is a front view of a sailboat, with the upper end of the fin contiguous with the hull or keel of the boat.

FIGS. 17 and 18 illustrate a sailboat 84 with a hollow tubular element 14 extending from the hull 86 of the boat. FIG. 19 shows an embodiment where a small stabilizing fin 10 attaches to the rear of the boat. The hollow element stabilizes the boat in more directions than can the keels currently in use. The stabilizing element gives the keel another edge to prevent up and down movement from choppy water, with minimal horizontal extension. Therefore, the stabilizing element smoothes the ride, making the boat more efficient.

FIG. 19 shows an airplane 88 with hollow tubular elements 14 attached to each wing 90. The tubular element 14 will make turning and gliding easier by cutting down on turbulence in a variety of directions. As a result, aircraft would travel more smoothly and get better gas mileage by reducing the effect of turbulence that detracts from forward motion. As used herein, the term "airplane" is intended to include aircraft generally, including, but not limited to, fixed wing aircraft having engines, gliders, and helicopters.

Figure 20:
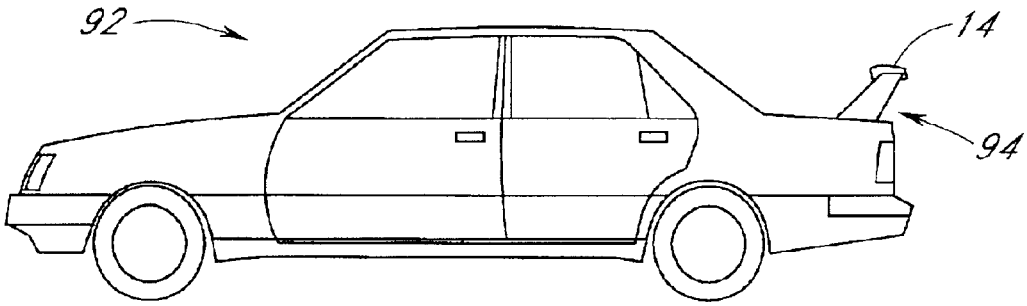
FIG. 20 is a side view of an automobile, with a stabilizing element attached at the rear of the automobile.

FIG. 20 shows an automobile 92 with a rear spoiler 94. In this embodiment, a hollow tubular element 14 is attached at the center of the spoiler 94. Although a spoiler with a single hollow element is shown, the spoiler could have two or more stabilizers. In an embodiment with two stabilizers, they stabilizers could be attached at the edges of the spoiler.

The hollow tubular element 14 could also be placed on a pivoting spoiler or on a fixed spoiler. A spoiler with this aperture has more area for wind resistance, slowing automobile when required and providing downward force, without requiring two fins. The hollow element 14 also helps eliminate turbulence as the automobile rounds corners, giving the driver more control. The stabilizing device can be attached from a center hollow element on a pedestal.

Figure 21:
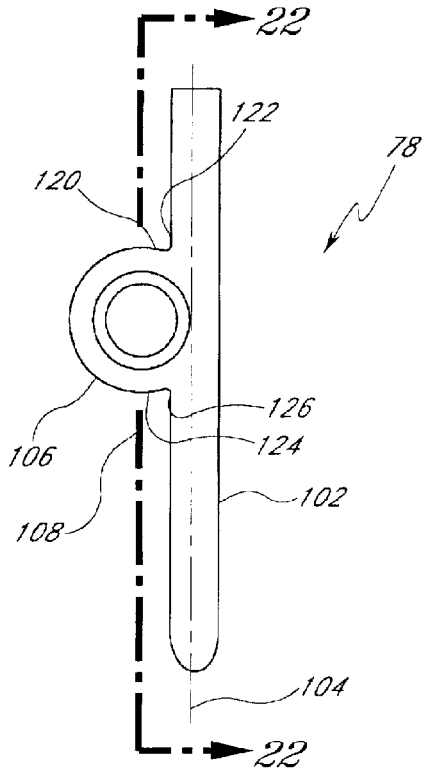
FIG. 21 a front end view of the stabilizing fin of FIG. 9B shown in greater detail.

FIG. 21 is a front end view of a stabilizer 100 that is similar to the stabilizing fin 78 of FIG. 9B. The stabilizer 100 is similar to the stabilizing fin 10, except as described below. The stabilizer 100 comprises a first element 102 that comprises a centerline 104 and a hollow tubular element 106 that comprises a centerline 108. In one embodiment, the centerline 104 of the first element 102 and the centerline 108 of the hollow tubular element 106 are offset, with the centerline 104 being positioned to the left of the centerline 108 as viewed from the front of the stabilizer 100. In another embodiment, the centerline 104 of the first element 102 and the centerline 108 of the hollow tubular element 106 are offset, with the centerline 104 being to the right of the centerline 108 as viewed from the front of the stabilizer 100. In one embodiment, the first element 102 comprises a planar element that is generally vertically oriented when attached to a mobile device, such as the surfboard of FIG. 9B. As with the fin 10, the stabilizer 100 can be attached by means known in the art (either permanently affixed or removable).

The hollow tubular element 106 and the first element 102 are preferably made as a single piece, i.e., of unitary construction. One method of making the stabilizing element 100 with a unitary construction incorporates an injection molding process. Other methods that can be used employ fiberglass and/or carbon fiber composites. The first element 102 and the hollow tubular element 106 could be made as separate pieces that are configured to be connected together by any of a number of attachment techniques, e.g., mechanical fasteners or adhesives. The upper portion of the first element 102 can also be contiguous with the bottom surface or hull of a sailboat, as shown in FIGS. 18–19.

The tubular element 106 has an open first end 110 and an open second end 112. In one embodiment, the first end 110 is larger than the second end 112. In another embodiment, the second end 112 is larger than the first end 110. In another embodiment, the first end 110 and the second end 112 are about the same size. In one embodiment, when the stabilizer 100 is mounted on a mobile device, the first end 110 is oriented toward the front of the mobile device. In another embodiment, the first end 110 is oriented toward the rear of the mobile device.

Figure 22:
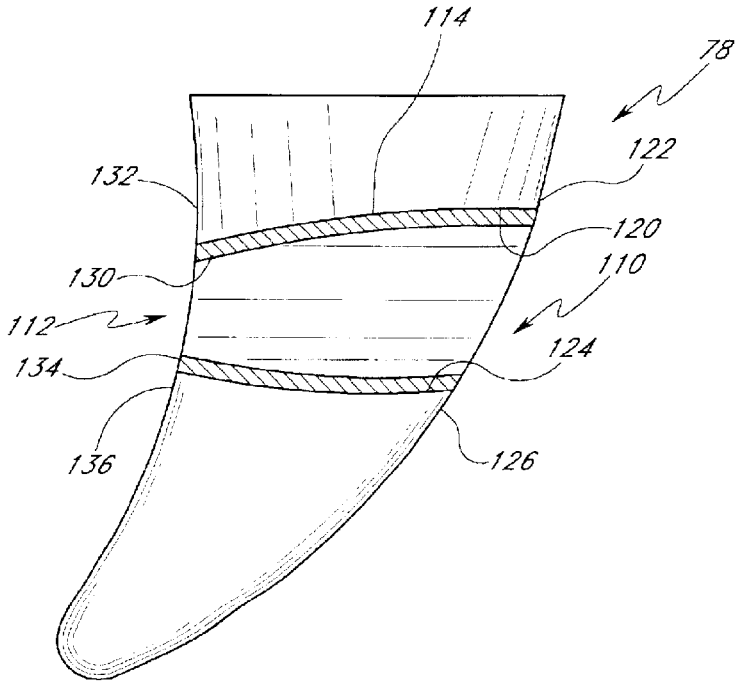
FIG. 22 is cross-section view of the fin of FIG. 21, taken along line 22—22.

The tubular element 106 also comprises, in one embodiment, a curved surface 114. The curved surface 114 can be located between the first end 110 and the second end 112 (See FIGS. 16A and 16B). The curved surface 114 is shown in FIG. 22 as the outer surface of the tubular element. However, the curved surface 114 could also be the inner surface of the tubular element 106. In one embodiment, the curved surface 114 is not the inner surface of the tubular element 106. The curved surface 114 could also be a surface of the first element 102.

In the context of a stabilizer for a water planing device, the tubular element 106 comprises a first upper portion 120 which adjoins a first joint portion 122 of the first element 102. The tubular element 106 comprises a first lower portion 124 which adjoins a second joint portion 126 of the first element 102. In one embodiment, as in FIG. 22, a continuous curve side profile is provided on the side of the stabilizer 100 having the open end 110.

In the embodiment illustrated in FIG. 22, the tubular element 106 also comprises an upper second portion 130 which adjoins a third joint portion 132 of the first element 102. The tubular element 106 also comprises a lower second portion 134 which adjoins a fourth joint portion 136. The tubular element 106 and the first element 102 are thus joined to provide a continuous side profile on the rear of the stabilizer 100 as well, as is shown in FIG. 22.

Figure 23:
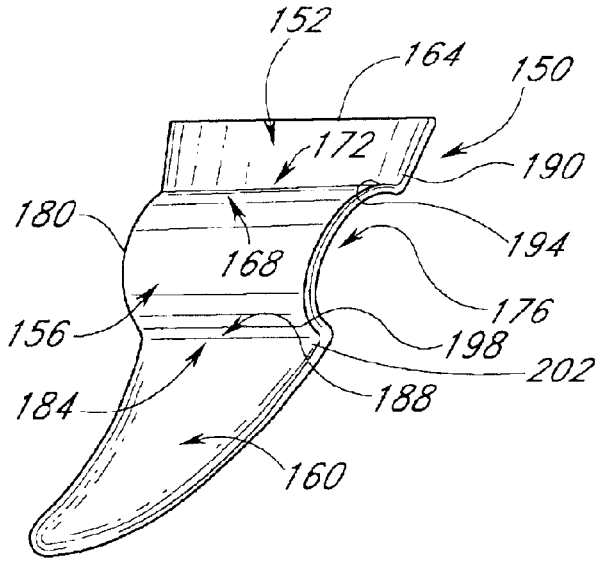
FIG. 23 is a front side perspective view of another embodiment of a stabilizing fin.
Figure 24:
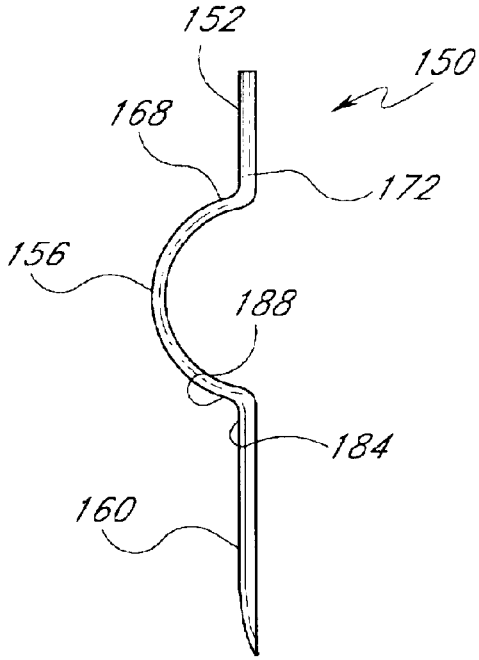
FIG. 24 is a rear end view of the embodiment shown in FIG. 23.

Referring now to FIGS. 23–24, another embodiment of a stabilizer 150 comprises an upper stabilizer element 152, an arcuate element 156 and a lower stabilizer element 160. In the embodiment shown, the upper stabilizer element 152 is generally shaped as a single vertically oriented plate, blade, or foil having a generally planar configuration. The upper stabilizer element 152 has an upper end 164 which attaches to a bottom surface of a water planing device, such as the surfboard, wind surfing board, or sailboat described herein, or other mobile devices. The upper stabilizer element 152 may be attached by means well known in the art (either permanently affixed or removable). The upper vertical stabilizer element 152 may also be contiguous with the bottom surface or hull of a sailboat, as shown in FIGS. 18–19, or other mobile devices.

The arcuate element 156 has an upper portion 168 which depends from a lower end 172 of the upper vertical stabilizer element 152. The arcuate element 156 has an open front end 176 and an open back end 180. In one embodiment, the cross-section of the arcuate element 156 is substantially semi-circular, spanning about 180 degrees of a circle. Thus, the arcuate element 156 is an open-sided, semi-tubular element in one embodiment. As used above, the term "arcuate element" is not limited to elements having constant cross-sectional area, but can include elements having cross-sectional area that varies between the front end and the back end, e.g., forming an outer or an inner curved surface. In one embodiment, the arcuate element 156 forms a curved surface. This curve may be on the outer side of the tubular element 156 or on the inner side of the tubular element 156.

The lower vertical stabilizer element 160 has an upper end 184 depending from a lower portion 188 of the arcuate element 156. The upper vertical stabilizer element 152, the arcuate element 156 and the lower vertical stabilizer element 160 are preferably integrally connected. They may be formed of typical surfboard fin materials such as fiberglass, injection-molded plastic, or carbon fiber composites. As discussed above, the stabilizer 150 can be constructed using carbon composite manufacturing processes.

As mentioned above in connection with the fin 10, the stabilizer 150 has, in one embodiment, a rounded leading edge and preferably has a tapered trailing edge.

As can be seen, for example in FIG. 23, in one embodiment a lower front portion 190 of the upper vertical stabilizer element 152 is contiguous with an upper front portion 194 of the arcuate element 156. A lower front portion 198 from the arcuate element 156 is contiguous with an upper front portion 202 of the lower vertical stabilizer element 160. Furthermore, a lower back portion 206 of the upper vertical stabilizer element 152 is contiguous with an upper back portion 210 of the arcuate element 156. A lower back portion 214 of the arcuate element 156 is contiguous with an upper back portion 218 of the lower vertical stabilizer element 160. Thus, as shown in FIG. 23, a continuous curve side profile is provided on both the front and back edges of the stabilizer 150. In another embodiment, the stabilizer 150 has only one contiguous edge, i.e., has a continuous curve side profile on only the front or back edge.

Many modifications and variations of the present invention are possible in light of the above teachings. Furthermore, the principles explained in connection with the surfboard embodiments are also applicable to the other mobile devices shown as well as others. It is, therefore, to be understood that within the scope of the appended claims, the invention may be practiced otherwise than as specifically described.

What is claimed is:

1. A stabilizer for a mobile device, comprising:

a first element having a center-plane, a front edge, and an upper end for attachment to a surface of the mobile device; and a hollow tubular element having a front end and a center-plane, the hollow tubular element being connected to the first element such that the center-plane of the hollow tubular element and the center-plane of the first element are offset, said front end and said front edge forming a continuous curve side profile.

2. The stabilizer of claim 1, wherein the hollow tubular element comprises an open first end and an open second end, the open first end being larger than the open second end.

3. The stabilizer of claim 1, wherein the hollow tubular element comprises an open first end, an open second end, and a curved surface between said first end and said second end.

4. The stabilizer of claim 1, wherein the hollow tubular element further comprises a back end and the first element further comprises back edge, said back end and said back edge forming a continuous curved surface.

5. The stabilizer of claim 1, wherein first element further comprises a top end and a bottom end, and the hollow tubular element is positioned between the top end and the bottom end.

6. A stabilizer for a mobile device, comprising:

a first element having a center-plane, an upper end for attachment to a bottom surface of the mobile device, and a bottom end; and a hollow tubular element positioned between the upper end and the bottom end, the hollow tubular element having a center-plane, the hollow tubular element being connected to the first element such that the center-plane of the hollow tubular element and the center-plane of the first element are offset;

wherein the hollow tubular element is positioned closer to the top end than to the bottom end.

7. A stabilizing system comprising:

a mobile device; and a stabilizer comprising:

a first element having a center-plane, a top end, and a bottom end, the first element connected to the mobile device; and a hollow tubular element positioned between the top end and the bottom end, the hollow tubular element having a center-plane, said hollow tubular element being connected to said first element such that the center-plane of the hollow tubular element and the center-plane of the first element are offset;

wherein during use thereof the hollow tubular element provides increased stability in at least two directions for enhanced control by a user, and wherein the hollow tubular element is positioned closer to the top end than to the bottom end.

8. A stabilizing system comprising:

a mobile device; and a stabilizer comprising:

a first element having a center-plane and a front edge, the first element connected to the mobile device; and a hollow tubular element having a front end and a center-plane, said hollow tubular element being connected to said first element such that the center-plane of the hollow tubular element and the center-plane of the first element are offset, said front end and said front edge forming a continuous curve side profile;

wherein during use thereof the hollow tubular element provides increased stability in at least two directions for enhanced control by a user.

9. The stabilizing system of claim 8, wherein the hollow tubular element comprises an open first end, an open second end, and a curved surface between said first end and said second end.

10. The stabilizing system of claim 8, wherein the hollow tubular element further comprises an open first end, and an open second end, the open first end being larger than the open second end.

11. The stabilizing system of claim 8, wherein the hollow tubular element further comprises a back end and the first element further comprises back edge, said back end and said back edge forming a continuous curved surface.

12. The stabilizing system of claim 8, wherein first element further comprises a top end and a bottom end, and the hollow tubular element is positioned between the top end and the bottom end.

13. The stabilizing system of claim 8, wherein the mobile device is a surfboard.

14. The stabilizing system of claim 8, wherein the mobile device is a wind surfing board.

15. The stabilizing system of claim 8, wherein the mobile device is an airplane.

16. The stabilizing system of claim 8, wherein the mobile device is an automobile.

17. A stabilizing element for a mobile device comprising:

an upper vertical stabilizer element having a front edge and an upper end for attachment to a bottom surface of the water planing device;

an arcuate element having a front end and an upper portion depending from a lower end of the upper vertical stabilizer element; and a lower vertical stabilizer element having an upper end depending from a lower portion of the arcuate element, said front end and said front edge forming a continuous curve side profile.

18. The stabilizing element of claim 17, wherein the arcuate element further comprises an open first end, an open second end, and a curved surface formed between the first end and the second end.

19. The stabilizing element of claim 17, wherein the arcuate element further comprises a first end and a second end, the first end being larger than the second end.

20. A stabilizing system comprising:

a mobile device; and a stabilizer comprising:

an upper vertical stabilizer element having a front edge and an upper end for attachment to a bottom surface of the mobile device;

an arcuate element having a front end and an upper portion depending from a lower end of the upper vertical stabilizer element; and a lower vertical stabilizer element having an upper end depending from a lower portion of the arcuate element, said front end and said front edge forming a continuous curve side profile.

21. A stabilizing system comprising:

a mobile device; and a stabilizer comprising:

an upper vertical stabilizer element having an upper end for attachment to a bottom surface of the mobile device;

an arcuate element having an upper portion depending from a lower end of the upper vertical stabilizer element; and a lower vertical stabilizer element having an upper end depending from a lower portion of the arcuate element, wherein the arcuate element has a semicircular transverse cross-section that spans about 180 degrees of a circle.

22. The stabilizing system of claim 20, wherein the arcuate element further comprises an open first end, an open second end, and a curved surface formed between the first end and the second end.

23. The stabilizer system of claim 20, wherein the arcuate element further comprises a first end and a second end, the first end being larger than the second end.

24. The stabilizing system of claim 20, wherein the mobile device is a surfboard.

25. The stabilizing system of claim 20, wherein the mobile device is a wind surfing board.

26. The stabilizing system of claim 20, wherein the mobile device is an airplane.

27. The stabilizing system of claim 20, wherein the mobile device is a automobile.

28. A stabilizer for a mobile device, comprising:

a first element having a center-plane and an upper end for attachment to a surface of the mobile device;

a hollow tubular element having a center-plane, an outside surface, and a rigid inside surface, the hollow tubular element being connected to the first element such that the center-plane of the hollow tubular element and the center-plane of the first element are offset; and wherein first element further comprises a top end and a bottom end, and the hollow tubular element is positioned between the top end and the bottom end.

29. A stabilizer for a mobile device, comprising:

a first element having a center-plane and an upper end for attachment to a surface of the mobile device;

a hollow tubular element having a center-plane, an outside surface, and a rigid inside surface, the hollow tubular element being connected to the first element such that the center-plane of the hollow tubular element and the center-plane of the first element are offset; and wherein the first element further comprises a front end and the tubular element further comprises a front edge, said front end and said front edge forming a continuous curve side profile.

30. A stabilizing system comprising:

a mobile device having a center-plane; and a stabilizer comprising:

a first element having a center-plane, the first element connected to the mobile device;

a hollow tubular element having a center-plane, an outside surface, and a rigid inside surface, the hollow tubular element being connected to the first element such that the center-plane of the hollow tubular element and the center-plane of the first element are offset;

wherein during use thereof the hollow tubular element provides increased stability in at least two directions for enhanced control by a user; and wherein the first element further comprises a front end and the tubular element further comprises a front edge, said front end and said front edge forming a continuous curve side profile.

31. The stabilizing system of claim 30, wherein the hollow tubular element comprises an open first end, an open second end, and a curved surface between said first end and said second end.

32. The stabilizing system of claim 30, wherein the hollow tubular element further comprises an open first end, and an open second end, the open first end being larger than the open second end.

33. The stabilizing system of claim 30, wherein the mobile device is a surfboard.

34. The stabilizing system of claim 30, wherein the mobile device is a wind surfing board.

35. The stabilizing system of claim 30, wherein the mobile device is an airplane.

36. The stabilizing system of claim 30, wherein the mobile device is an automobile.

37. A stabilizing element for a mobile device comprising:

an upper vertical stabilizer element having an upper end for attachment to a bottom surface of the water planing device;

an open arcuate element spanning less than 360 degrees and having an upper portion depending from a lower end of the upper vertical stabilizer element; and a lower vertical stabilizer element having an upper end depending from a lower portion of the arcuate element.

38. The stabilizing element of claim 37, wherein the arcuate element further comprises an open first end, an open second end, and a curved surface formed between the first end and the second end.

39. The stabilizing element of claim 37, wherein the arcuate element further comprises a first end and a second end, the first end being larger than the second end.

40. The stabilizing element of claim 37, wherein the upper vertical stabilizer element further comprises a front end and the arcuate element further comprises a front edge, said front end and said front edge forming a continuous curve side profile.

41. A stabilizing system comprising:

a mobile device; and a stabilizer comprising:

an upper vertical stabilizer element having an upper end for attachment to a bottom surface of the mobile device;

an open arcuate element spanning less than 360 degrees and having an upper portion depending from a lower end of the upper vertical stabilizer element; and a lower vertical stabilizer element having an upper end depending from a portion of the arcuate element.

42. The stabilizing system of claim 41, wherein the arcuate element further comprises an open first end, an open second end, and a curved surface formed between the first end and the second end.

43. The stabilizer system of claim 41, wherein the arcuate element further comprises a first end and a second end, the first end being larger than the second end.

44. The stabilizing system of claim 41, wherein the upper vertical stabilizer element further comprises a front end and the arcuate element further comprises a front edge, said front end and said front edge forming a continuous curve side profile.

45. The stabilizing system of claim 41, wherein the mobile device is a surfboard.

46. The stabilizing system of claim 41, wherein the mobile device is a wind surfing board.

47. The stabilizing system of claim 41, wherein the mobile device is an airplane.

48. The stabilizing system of claim 41, wherein the mobile device is a automobile.

* * * * *